United States Patent [19]

Bergman et al.

[11] 4,340,836

[45] Jul. 20, 1982

[54] ELECTRODE FOR MINIATURE HIGH PRESSURE METAL HALIDE LAMP

[75] Inventors: Rolf S. Bergman, Cleveland Hts.; William H. Lake, Novelty, both of Ohio

[73] Assignee: General Electric Company, Schenectady, N.Y.

[21] Appl. No.: 940,957

[22] Filed: Sep. 11, 1978

[51] Int. Cl.[3] ..... H01J 17/06; H01J 61/073

[52] U.S. Cl. ..... 313/211; 313/213

[58] Field of Search ..... 313/217, 211, 344

[56] References Cited

U.S. PATENT DOCUMENTS

| | | | |
|---|---|---|---|
| 2,218,345 | 10/1940 | Spaeth | 313/217 |
| 2,241,362 | 5/1941 | Gustin et al. | 313/40 |
| 3,003,077 | 10/1961 | Thomas | 313/344 X |
| 3,588,579 | 6/1971 | Michael | 313/344 |
| 3,937,996 | 2/1976 | Cap | 313/217 |
| 4,105,908 | 8/1978 | Harding et al. | 313/217 |
| 4,136,298 | 1/1979 | Hansler | 313/217 |
| 4,161,672 | 7/1979 | Cap et al. | 313/220 |

FOREIGN PATENT DOCUMENTS

| | | | |
|---|---|---|---|
| 1014340 | 12/1965 | United Kingdom | 313/344 |

*Primary Examiner*—Robert Segal

*Attorney, Agent, or Firm*—Ernest W. Legree; Fred Jacob

[57] ABSTRACT

An electrode for a miniature high pressure metal halide lamp having a volume not exceeding 1 cc and a discharge current not exceeding 1 ampere comprises a slender tungsten shank with a few secondary turns of mandrel-less coiled-coil overwind thereon and preferably a balled distal end. The shank diameter is chosen in the range of 5 to 15 mils and above the size where melt-back starts at the intended lamp current, and the overwind is made of primary wire not exceeding 3 mils originally wound on a primary mandrel of 3 to 7 mils subsequently removed. This assures a rapid glow-to-arc transition which provides good maintenance and also reduces ballast requirements.

9 Claims, 3 Drawing Figures

0
1
2
3
CENTIMETERS 7
1
3
4'
6
11
11'
6'
5
4
3'
5'
2

11
12
6

12
13
6

ELECTRODE FOR MINIATURE HIGH PRESSURE METAL HALIDE LAMP

The invention relates to a self-heating electrode for use in miniature high pressure metal vapor lamps having very small discharge volumes such as about 1 cubic centimeter or less and which is particularly suitable for metal halide lamps wherein conventional alkaline earth oxide electron emission materials cannot be used.

BACKGROUND OF THE INVENTION

It has until recently been generally accepted that the efficacy of discharge lamps inevitably decreases as the lamp size or wattage is reduced. As a result of this belief, discharge lamps for general lighting applications have not been developed in miniature sizes. However in the pending application of Daniel M. Cap and William H. Lake, Ser. No. 912,628, filed June 5, 1978, titled "High Pressure Metal Vapor Discharge Lamps of Improved Efficacy", which is assigned like this application, now U.S. Pat. No. 4,161,672, new miniature discharge lamps having envelope volumes of about 1 cubic centimeter or less are disclosed. These lamps have input ratings starting at about 100 watts and going down to less than 10 watts. They utilize fillings preferably comprising mercury and metal halides and have characteristics including life durations making them suitable for general lighting purposes. While the input wattage is reduced, ratios of arc watts to electrode watts similar to those in larger sizes of lamps are maintained by increasing the mercury vapor pressure at the same time as the discharge volume is decreased. It is necessary to maintain the desired electrode temperature with the reduced energy input, and this is achieved primarily by reducing the physical size of the electrodes and inleads in order to reduce the heat loss from them.

In lamps wherein the electrodes do not carry electron emission material in the conventional sense of alkaline earth metal or oxides, the criteria for the size of wire used for the overwind on the electrodes are much more critical than in lamps containing emission material. In the latter, the overwind is simply of a wire size which is adequate to retain mechanically the emission material, and which does not overheat by joule effect and cause excessive vaporization of emission material at the operating current. By way of example, in a mercury vapor lamp containing barium oxide as emission material, the electrode temperature should not exceed 1500° K. and the wire size should be chosen accordingly. By contrast, in lamps without emission material or relying only upon plating out of thorium from thorium iodide in the fill for electrode activation, a temperature of 2500° to 3000° K. must be achieved in order to obtain adequate electron emission at a work function of 3.5 to 4.5 volts (by comparison with a work function of 1.5 to 2 where BaO is present). However at temperatures above 3300° K., tungsten vaporizes at such a rate that the small envelope of the miniature lamp blackens rapidly. Accordingly the design must achieve the desired operating modes within these narrow temperature constraints. Thus a much more critical problem is presented which is made even more acute by the small size of the lamp.

SUMMARY OF THE INVENTION

The object of the invention is to provide a new electrode of small physical size which does not contain alkaline earth emission material and which is suitable for use in miniature metal halide arc tubes of 1 cc volume or less operating with discharge currents of 1 ampere or less to achieve easy starting and good lamp maintenance.

We have discovered that, in order to satisfy the critical temperature regime required during the starting phase, it is necessary to have a certain ratio of surface area to mass in the overwind and better results are achieved by an overwind not containing a mandrel. According to our invention, the electrode comprises a slender tungsten shank having a coiled coil tungsten wire overwind of 2 to 5 secondary turns thereon. The shank diameter is chosen slightly above the size where meltback starts at the intended lamp current, suitably in the range of 5 to 15 mils. The overwind or primary wire consists of fine wire relative to the shank, suitably of 3 mils or less wound on a primary mandrel of 3 to 7 mils. The primary mandrel is removed from the completed electrode and this has been found to produce better results in achieving the rapid glow-to-arc transition desired for good maintenance and reduced ballast requirements.

In a preferred embodiment using a 7 mil tungsten shank, the overwind consists of 3 to 4 secondary turns of 2.5 mil primary tungsten wire coiled on a 4 mil primary molybdenum mandrel which is subsequently removed. The tip of the shank projects 0.015" to 0.025" beyond the coiling and is formed into a ball about 0.020" in diameter.

DETAILED DESCRIPTION

Figure 1:
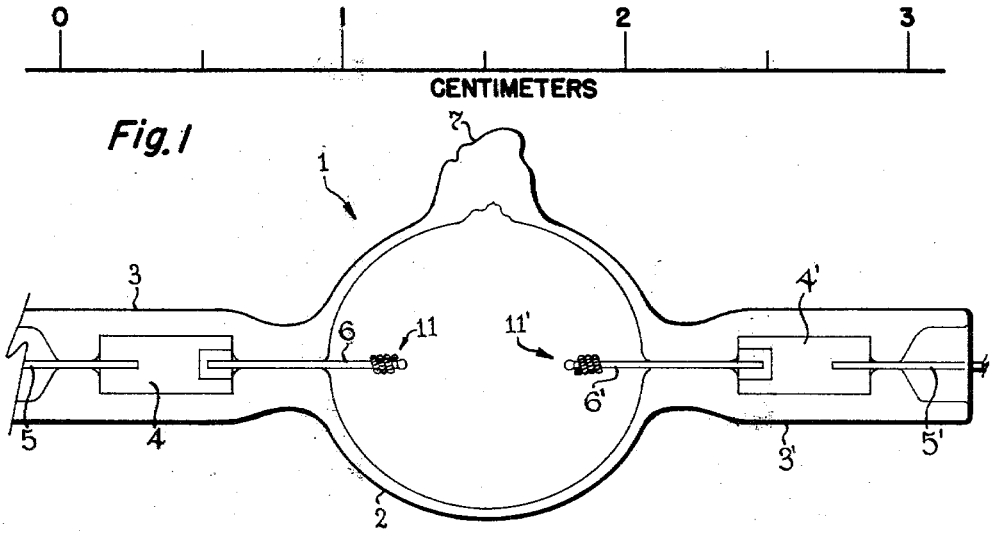
FIG. 1 illustrates, to the scale shown above the figure, a miniature discharge lamp provided with a pair of electrodes embodying the invention.

The invention is particularly useful for miniature metal halide lamps such as those described in the previously mentioned copending application of Cap and Lake, an example of which is illustrated in FIG. 1. Such a lamp may comprise a small arc tube 1, generally less than 1 cc in volume, whose size may be judged from the centimeter scale shown above. The envelope is made of quartz or fused silica and comprises a central bulb portion 2 which may be formed by the expansion of quartz tubing, and neck portions 3,3' formed by collapsing or vacuum sealing the tubing upon molybdenum foil portions 4,4' of electrode inlead assemblies. Leads 5,5' welded to the foils project externally of the necks while electrode shanks 6,6' welded to the opposite sides of the foils extend through the necks into the bulb portion.

A suitable filling for the envelope comprises argon or other inert gas at a pressure of several tens of torr to serve as starting gas, and a charge comprising mercury and one or more metal halides. A preferred filling comprises NaI, $ScI_3$ and $ThI_4$. Our electrodes also operate well with a filling comprising NaI and $ScI_3$ without $ThI_4$. The charge may be introduced through an exhaust tube extending from the side of the bulb and which is then eliminated by tipping off, leaving a vitreous residue indicated at 7. Alternatively the charge may be introduced into the arc chamber through one of the necks before sealing in the second electrode; in such case the arc chamber portion is chilled during the heat sealing of the neck to prevent vaporization of the charge. The arc tube is usually mounted within an outer protective envelope or jacket (not shown) having a base to whose contact terminals the leads, 5,5' of the arc tube are connected.

The invention is concerned with the electrode structures 11,11' mounted or formed upon the end of the shanks 6,6'. High pressure metal vapor arc lamps commonly utilize compact self-heating electrodes, a common design being a single or a two-layer coil on a tungsten shank with the interstices between turns being filled with emissive material. Materials commonly used are alkaline earth oxides in the case of mercury vapor lamps. In metal halide lamps comprising scandium iodide and thorium iodide in the fill, reliance is placed upon pyrolitic decomposition of the thorium iodide followed by condensation of thorium metal on the electrode surface particularly at the tip of the shank to provide a surface which emits electrons more efficiently than pure tungsten. However none of the prior art structures give optimum performance in miniature metal halide lamps, particularly those containing scandium and thorium iodides and operated on a.c. ballasts.

Figure 2:
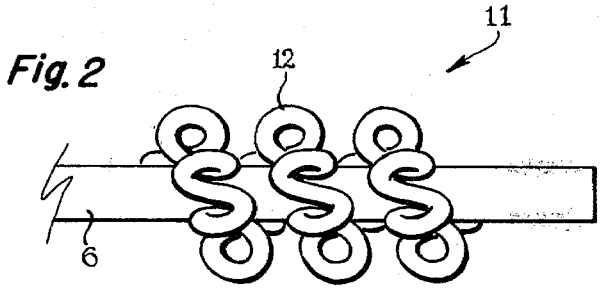
FIG. 2 is an enlarged view of an electrode embodying the invention.

We have found that an electrode design consisting of a shank with a coiled-coil mandrel-less overwind, appropriately miniaturized, gives definite performance advantages particularly when the lamps are operated on a.c. An example of a design embodying our invention and suitable for the lamp of FIG. 1 is illustrated in FIG. 2. The overwind is formed by close-winding a primary wire of 2.5 mil tungsten on a primary mandrel of 4 mil molybdenum; 3 to 4 turns of the composite are then coiled on the 7 mil shank 6. After coiling the molybdenum mandrel is removed, suitably through the use of a solution of hydrochloric and nitric acids which attacks molybdenum but not tungsten. The outer portions of the primary turns open up as the coil is wound around the tungsten shank while the inner portions tend to compact or bunch together. The mandrel-less coiled coil 12 of 2.5 mil tungsten wire is preferably spot welded at each end to the tungsten shank 6, suitably using a laser for the purpose.

Figure 3:
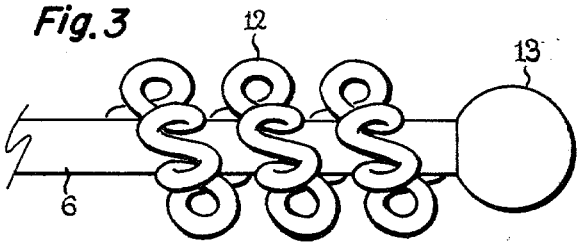
FIG. 3 is an enlarged view of another electrode embodying the invention and provided with a balled end to the shank.

When the coiled-coil 12 is mounted on the shank 6, the shank is allowed to protrude a short distance beyond the coil, for instance 0.015 to 0.025". After the arc is ignited and the lamp has heated up and reached a stable operating condition, the arc attaches to the tip of the shank. The illustrated electrode is suitable for a miniature metal halide lamp of 25 to 35 watts size which operates with a current from 200 to 500 milliamperes. At the upper end of this current range and even more so if it is exceeded, the shank tip tends to round off and form a hemispherical end by melting during lamp operation. This of course means that the electrode lengths and the arc gap are changing during life of the lamp, along with the parameters and operating characteristics dependent thereon. However once the shank tip has rounded and even more so if it is balled up, further melting back is inhibited and the electrode length and arc gap substantially stabilize. Accordingly, such stabilization may be achieved by initially operating the lamp at an excessive current just long enough to form a molten ball on the shank tip. However an alternative and preferred method is to form the ball during electrode fabrication by using a plasma torch to melt back the shank protrusion. Such a ball on the distal end of the shank is shown at 13 in FIG. 3 having a diameter of approximately 0.02". The combination of an open coiled-coil overwind with a balled end on the electrode shank reduces electrode erosion while maintaining fast glow-to-arc transition time.

Another example of an electrode design embodying our invention comprises a 1.8 mil primary wire coiled on a 4 mil molybdenum primary mandrel which is subsequently removed after the composite wire is wrapped around the secondary mandrel which forms the electrode shank. The finer overwind of this example also gave good results.

The advantages of our electrode design in miniature high pressure metal vapor lamps are believed to result from the following factors:

1. The small mass and low thermal conduction of one of the coiled-coil loops makes transition from glow-to-arc mode much easier when the electrode is cold and this reduces the time and energy needed for the transition.

2. The shank serves as the main electron collector when operating as anode, and also, after it has heated up to normal temperature, as the main electron emitter when operating as cathode. This means that the delicate overwind is not eroded during normal operation of the lamp.

What we claim as new and desire to secure by Letters Patent of the United States is:

1. A miniature metal vapor lamp arc tube comprising a fused silica envelope having a volume not exceeding 1 cc and containing an ionizable fill comprising mercury and metal halides, electrodes without alkaline earth electron emission material sealed into opposite ends of said envelope for supporting a discharge current not exceeding 1 ampere, each electrode comprising a tungsten shank in the range of 5 to 15 mils and above the wire size at which melt-back occurs at the current level in said lamp, and a mandrel-less coiled-coil single-layer overwind of primary tungsten wire not exceeding 3 mils originally wound on a primary mandrel of 3 to 7 mils subsequently removed, said overwind being wrapped around said shank and extending short of the tip thereof.

2. A lamp as in claim 1 wherein NaI and $ScI_3$ are included in the metal halide fill.

3. A lamp as in claim 1 wherein the fill comprises mercury, NaI, $ScI_3$ and $ThI_4$.

4. A lamp as in claim 1 for operation at a current in the range of 200 to 500 milliamperes wherein the electrode shank is tungsten wire in the range of approximately 7 to 9 mils and the overwind is made of primary tungsten wire in the range of approximately 1.8 to 2.5 mils originally close-wound on a primary mandrel of approximately 4 mils.

5. A lamp as in claim 4 wherein the electrode shank is approximately 7 mils and the overwind is made of primary tungsten wire of approximately 1.8 mil originally close wound on a primary mandrel of approximately 4 mils.

6. A lamp as in claim 1 wherein said shank is provided with a balled distal end.

7. A lamp as in claim 1 wherein said overwind comprises 2 to 5 secondary turns and said shank is provided with a balled distal end.

8. A lamp as in claim 7 wherein the fill comprises mercury, NaI and $ScI_3$.

9. A lamp as in claim 7 wherein the fill comprises mercury, NaI, $ScI_3$ and $ThI_4$.

* * * * *